US006961437B2

(12) United States Patent
Kondo et al.

(10) Patent No.: US 6,961,437 B2
(45) Date of Patent: Nov. 1, 2005

(54) CAPACITOR MICROPHONE

(75) Inventors: Kazuhisa Kondo, Yamato (JP); Noriko Matsui, Tokyo (JP)

(73) Assignee: Kabushiki Kaisha Audio-Technica, Machida (JP)

( * ) Notice: Subject to any disclaimer, the term of this patent is extended or adjusted under 35 U.S.C. 154(b) by 0 days.

(21) Appl. No.: 11/009,730

(22) Filed: Dec. 10, 2004

(65) Prior Publication Data

US 2005/0135640 A1 Jun. 23, 2005

(30) Foreign Application Priority Data

Dec. 19, 2003 (JP) ..... 2003-421769

(51) Int. Cl.[7] ..... H04R 25/00
(52) U.S. Cl. ..... 381/174; 381/369; 381/191
(58) Field of Search ..... 381/353, 354, 381/355, 360, 368, 369, 174, 191; 29/25.41, 594; 367/140, 170, 181

(56) References Cited

U.S. PATENT DOCUMENTS 5,272,758 A * 12/1993 Isogami et al. ..... 381/191

6,549,632 B1 * 4/2003 Akino et al. ..... 381/174

* cited by examiner

*Primary Examiner*—Huyen Le
(74) *Attorney, Agent, or Firm*—Welsh & Katz, Ltd.

(57) ABSTRACT

It is an object of the present invention to securely prevent a generation of an acoustic resonance due to a rear air chamber of a capsule support in a capacitor microphone including a microphone capsule and the capsule support and to improve assembly of a contacting terminal which is mounted in the capsule support. According to FIG. 1, a capacitor microphone of the present invention includes a microphone capsule 20 and a capsule support 10A which are connected through a connecting screw 24. A contacting terminal 140 contacting to a contact pin 23 of the microphone capsule 20 is disposed on the printed circuit board 120 housed in the capsule support 10A with an electric insulating block 180 held in the contacting terminal 140 and is fixed through the block 180 and an electric insulating cap member 160. Whereby, the cap member 160 increases the air proof grade of a rear air chamber and makes the air volume of the chamber as small as possible and constant so that an acoustic resonance is not generated.

16 Claims, 4 Drawing Sheets

CAPACITOR MICROPHONE

FIELD OF THE INVENTION

The present invention relates to a capacitor microphone which includes a microphone capsule and a capsule support supporting the microphone capsule. More particularly, the invention relates to the structure of a contact in the capsule support to which the microphone capsule is attached.

BACKGROUND OF THE INVENTION

A so-called compact microphone is practically a capacitor microphone. Regarding to a goose-neck type capacitor microphone which is seen at a conference room or the like, a microphone of which a microphone capsule can be exchanged is in existence in order to change the microphone characteristics according to the surroundings. Referring to FIG. 5, one of the examples will be described.

A capacitor microphone includes a capsule support 10 which is mounted on the top end of a supporting pipe P and a microphone capsule 20 which is removably connected to the capsule support 10 with a screw latch. The supporting pipe P generally stands on a desk through a microphone stand (not shown) and a part of the pipe P uses a flexible shaft.

The microphone capsule 20 has a cylindrical chassis 21 formed with aluminum or the like. It is not shown that a vibrating plate and a fixed electrode are faced to each other and disposed through an insulating spacer in the chassis 21, the vibrating plate strained and fixed on a supporting ring, the fixed electrode formed with an electret board or the like and supported on an insulating pedestal.

The back side of the chassis 21 is closed with a rear cover 22. A contact pin 23 connected to the fixed electrode protrudes from the rear cover 22. A connecting screw 24 which has an internal screw 241 on the inner surface thereof for connecting to the capsule support 10 is fixed on the back side of the chassis 21 to be electrically conducted to the chassis 21.

The capsule support 10 has a cylindrical chassis 11 formed with brass or the like. A circuit board 12 is disposed in the chassis 11 as to close the inside of the chassis. An impedance converter (FET: Field Effect Transistor) 13 is mounted on the circuit board 12. One end of an electric cable 17 which is passed and extracted through the supporting pipe P is soldered on the lower surface of the circuit board 12.

A piece of a contacting terminal 14 which is bent in a substantial V-shape and which is formed with a plate spring is soldered on the gate terminal of the impedance converter 13 to elastically contact to the contact pin 23. The circuit board 12 is fixed in the chassis 11 with a fixing ring 15.

That is, the outer circumference of the fixing ring 15 has an external screw 151 and on the other hand, a step 111 receiving the circuit board 12 and an internal screw 112 screwing with the external screw 151 are formed in the chassis 11. The circuit board 12 is pressed and fixed to the step 111 by screwing the fixing ring 15 to the internal screw 112.

The length of thread engagement of the fixing ring 15 with the internal screw 112 is a substantially lower-half of length of the external screw 151. The remaining upper-half of the external screw 151 is screwed with the internal screw 241 of the connecting screw 24 to connect to the microphone capsule 20. After the circuit board 12 has been fixed, a bulking agent 16 of silicon resin or the like is filled in a recess between the impedance converter 13 and the fixing ring 15.

The microphone capsule 20 and the capsule support 10 are mechanically connected by screwing the internal screw 241 of the connecting screw 24 to the external screw 151 of the fixing ring 15 so that the contact pin 23 elastically contacts and electrically connects to the contacting terminal 14. The chassis 21 of the microphone capsule 20 and the chassis 11 of the capsule support 10 are also electrically conducted through the fixing ring 15.

According to the connecting structure described above, the microphone capsule 20 can be easily attached to and removed from the capsule support 10 only by turning the microphone capsule. However, since the bulking agent 16 of silicon resin or the like is filled in the recess between the impedance converter 13 and the fixing ring 15, acoustic or environmental problems and problems in assembly or in maintenance, which will be described hereinafter, have been generated.

The recess between the impedance converter 13 and the fixing ring 15 increases the volume of the rear air chamber of the microphone capsule 20. The larger volume of the rear air chamber becomes a factor which generates an acoustic resonance and the resonance exerts bad influences upon a frequency response or a directional characteristic of the microphone capsule 20.

Therefore, in order to prevent things described above, the bulking agent 16 of silicon resin or the like is filled in the recess between the impedance converter 13 and the fixing ring 15, however, it is difficult to maintain the volume of the bulking agent. Since each of the microphones has each different volume of the rear air chamber, the variation of the air volume exerts subtle influences upon the frequency response or the directional characteristic of the microphone capsule 20.

Further, a dry process needs to be added after the bulking agent is filled and it takes more time to produce the microphones due to the additional dry process. The process reduces the productivity of the microphones. Further, a problem in a maintenance work occurs as follows. For example, the bulking agent 16 may be damaged when the circuit board 12 is removed. In this case, the bulking agent needs to be removed and the filling work of the bulking agent should be repeated.

Another problem besides that relating to the bulking agent may happen. Since the contacting terminal 14 is soldered to the gate terminal of the impedance converter 13 in the prior art, the assembling work including the soldering work is complicated so that the productivity of the microphone is reduced.

When a solder with lead is used, the care for the environment needs. Lead-free solder can be used, however, the lead-free solder needs higher heating temperature and is more expensive than the solder with lead so that the lead-free solder cannot be employed.

SUMMARY OF THE INVENTION

It is an object of the present invention to securely prevent a generation of an acoustic resonance due to a rear air chamber of a capsule support in a capacitor microphone including a microphone capsule and the capsule support and to improve assembly of a contacting terminal which is mounted in the capsule support.

In order to carry out the object, the capacitor microphone of this invention includes a microphone capsule and the capsule support which are connected through screw latching means. A vibrating plate and a fixed electrode are disposed in the microphone capsule with the plate and the electrode facing to each other and a contact pin is extracted from the fixed electrode toward the capsule support. The capsule support includes a printed circuit board and a contacting terminal and the printed circuit board has an impedance converter. The contacting terminal electrically contacts to a given terminal of the impedance converter and is formed with a plate spring elastically contacting to the contact pin. The microphone capsule and the capsule support connects through the screw latching means so that the microphone capsule and the capsule support electrically contact to each other. The capacitor microphone is characterized in that the impedance converter is mounted on the back surface relating to the microphone capsule of the printed circuit board and an electrode pattern electrically connecting to a given terminal of the impedance converter through predetermined conducting means is formed on the front surface relating to the microphone capsule of the printed circuit board, the contacting terminal including a bottom plate contacting to the electrode pattern, a side plate and a contacting piece, the side plate extending at a substantially right angle toward the microphone capsule 20 from one end of the bottom plate and the contacting piece obliquely extending in the upper direction at a designated angle from the top end of the side plate, the contacting terminal formed in a substantial U-shape with the bottom and the side plates, and the contacting piece. The capacitor microphone is further characterized in that the capacitor microphone includes an electric insulating block, a cap member and a fixing ring, the insulating block disposed on the bottom plate in the contacting terminal, the cap member having an opening fitting the block with the contacting piece protruding in the upper direction, the cap member disposed between the block and the circumference of the printed circuit board, the fixing ring mounted in a chassis of the capsule support while pressing the circumference of the cap member to the printed circuit board.

The cap member can be formed with either hard or soft resin. However, it is preferable that the cap member is formed with a rubber elastic body in order to increase the air proof grade of the rear air chamber and to make the air volume of the chamber as small as possible and constant.

It is preferable that a ring shaped rubber packing is placed between the cap member and the printed circuit board in order to further increase the air proof grade of the rear air chamber of the capsule support.

When the microphone capsule is turned in order to remove the microphone capsule from the capsule support, it is preferable that anti-rotating means for preventing the contacting terminal from rotating or twisting is formed in the opening of the cap member.

Included in the invention is an aspect that a ground pattern of the impedance converter is so formed on the circumference of the printed circuit board as to contact to the chassis of the capsule support and the fixing ring while the chassis of the microphone capsule and the capsule support are electrically connected through the fixing ring.

According to this invention, the cap member increases the air proof grade of the rear air chamber and makes the air volume of the chamber as small as possible and constant so that the acoustic resonance is not generated. An assembling work relating to the block is only that the cap member is inserted to the block, and no solder is used to mount the contacting terminal so that the assembling work remarkably improves.

The capacitor microphone is easily decomposed and re-assembled in maintenance. Further, the chassis of the microphone capsule and the capsule support are securely connected to the ground pattern of the printed circuit board.

DETAILED DESCRIPTION OF THE PREFERRED EMBODIMENTS

Referring to FIGS. 1 to 3 and 4*a* to 4*c*, an embodiment of the present invention will be described, however, the invention is not restricted to this embodiment.

Figure 1:
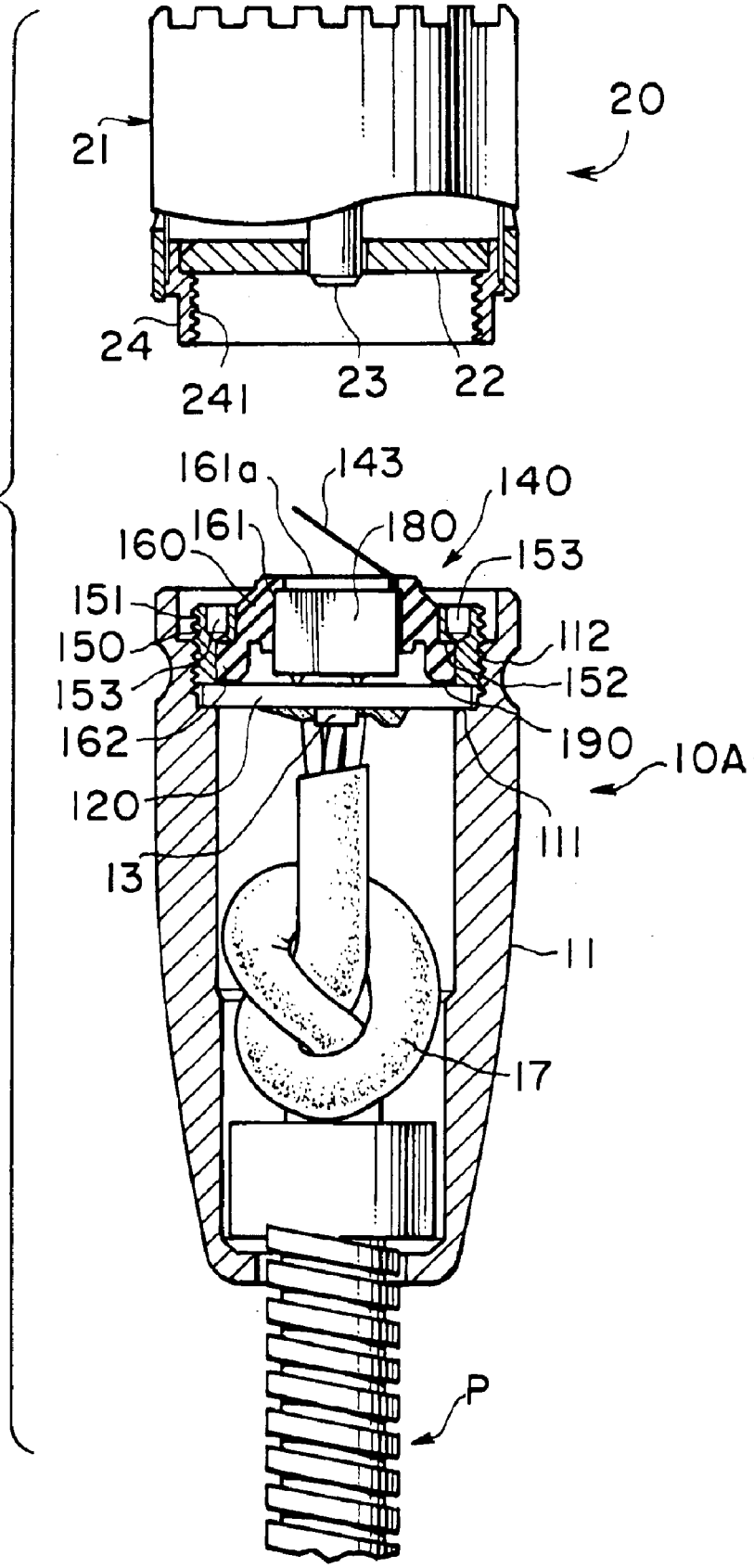
FIG. 1 is a cross sectional view of a capacitor microphone which is separated into a microphone capsule and a capsule support embodying the present invention.
Figure 2:
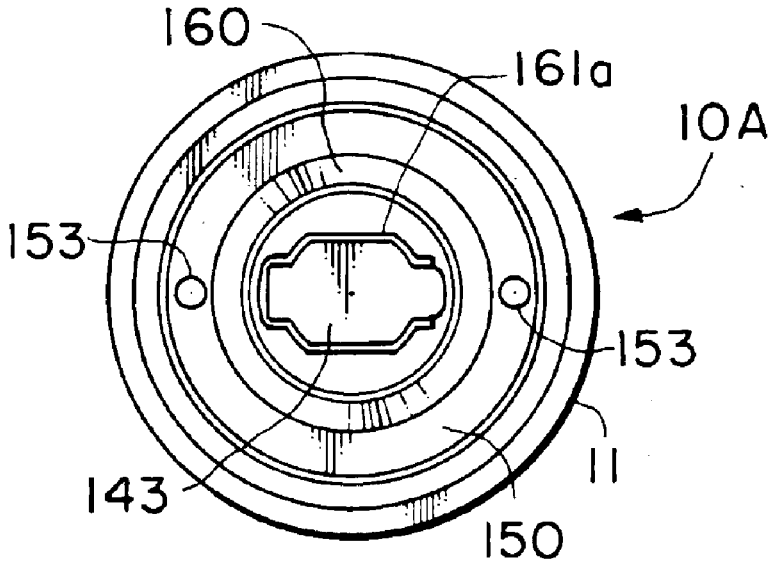
FIG. 2 is a plan view illustrating the capsule support.
Figure 3:
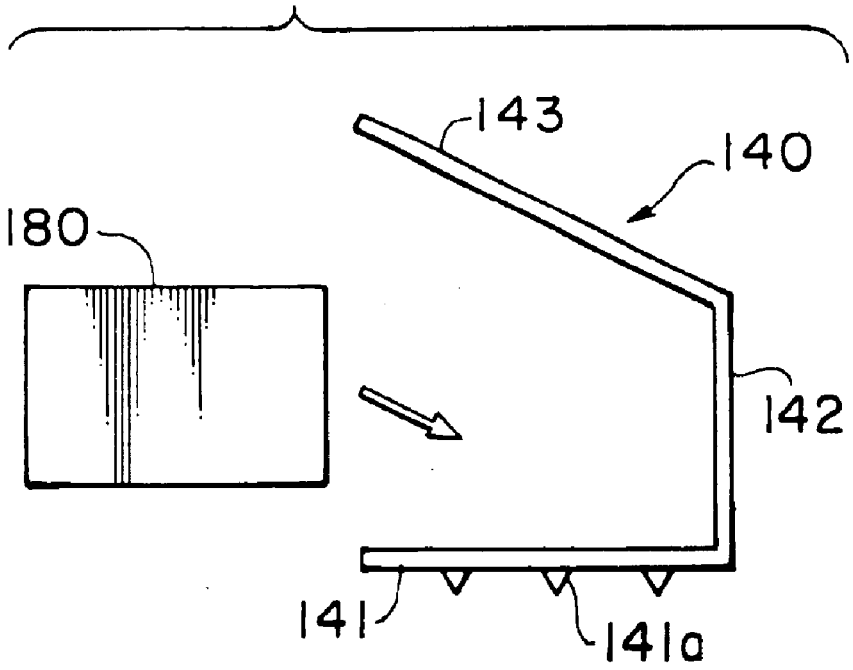
FIG. 3 is a side view illustrating a contacting terminal and a block, which are separated, housed in the capsule support.
Figure 4A:
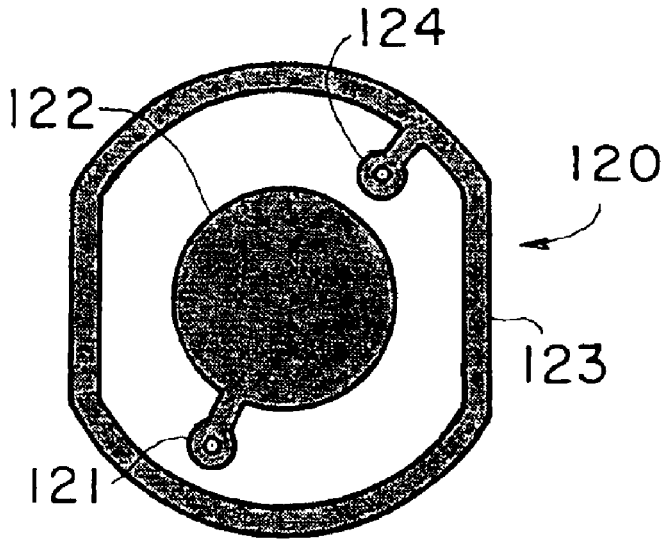
FIGS. 4*a*, 4*b* and 4*c* are, respectively, a plan, a side and a bottom views of a printed circuit board housed in the capsule support.
Figure 4B:
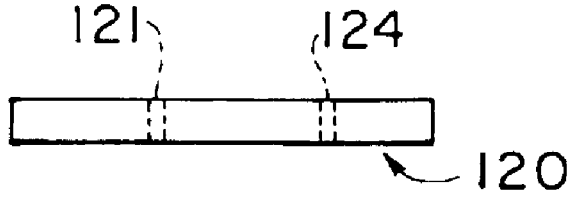
Figure 4C:
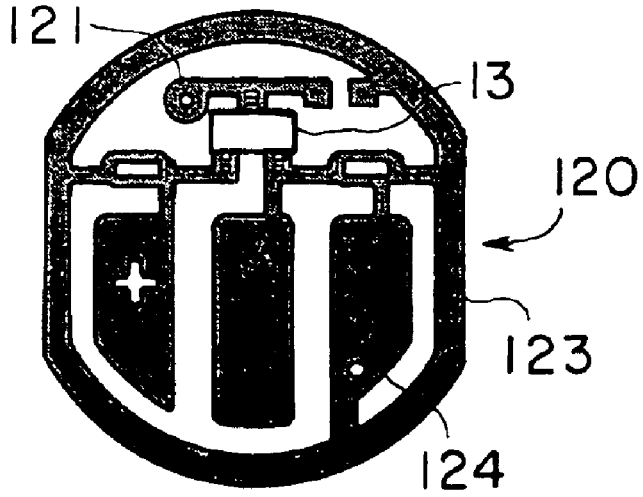

FIG. 1 shows a capacitor microphone which is separated into a microphone capsule 20 and a capsule support 10A of the invention. FIG. 2 is a plan view illustrating the capsule support 10A. FIG. 3 is a side view illustrating a contacting terminal 140 and a block 180, which are separated, housed in the capsule support 10A, and FIGS. 4*a*, 4*b* and 4*c* are, respectively, a plan, a side and a bottom views of a printed circuit board 120 housed in the capsule support 10A.

Figure 5:
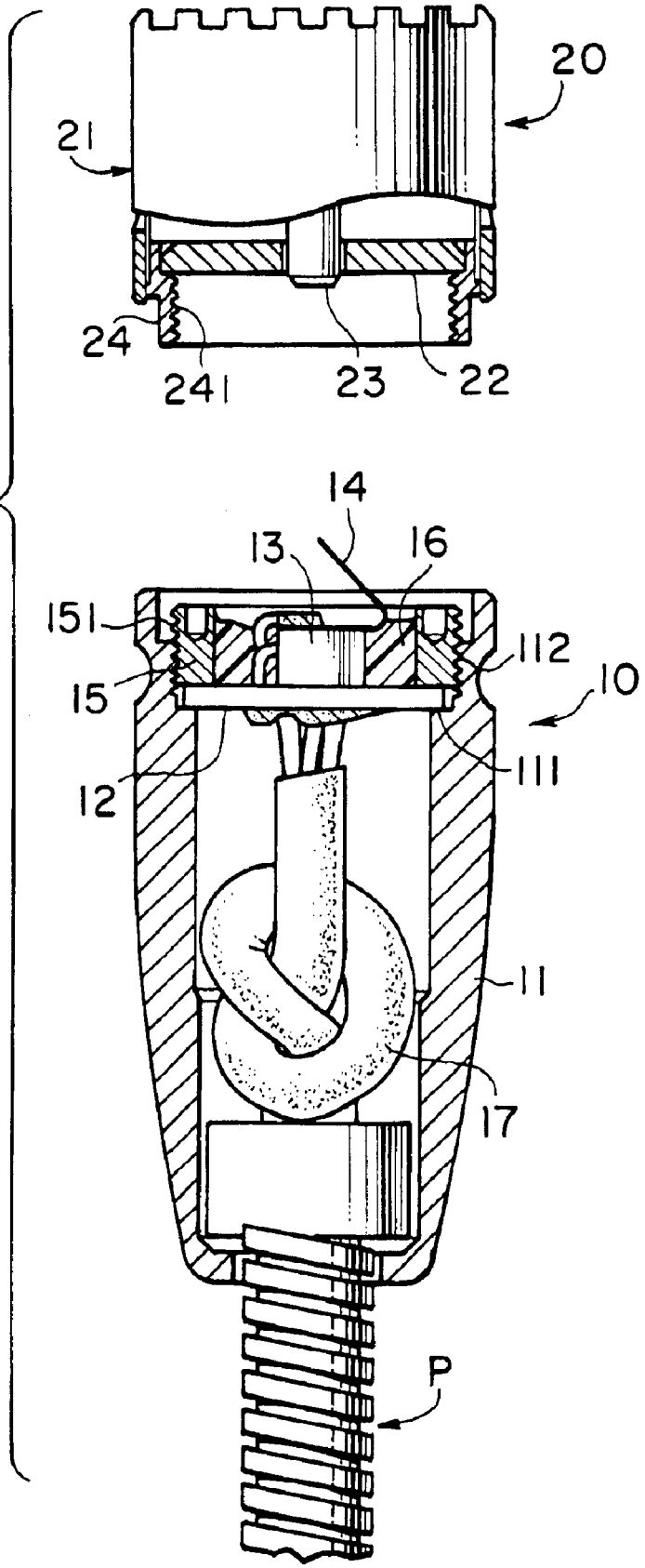
FIG. 5 PRIOR ART
FIG. 5 is a cross sectional view of a capacitor microphone which is separated into a microphone capsule and a capsule support of a prior art.

Constitutional elements in FIGS. 1 to 3 and 4*a* to 4*c* which are the same or are deemed to be the same as the elements of a microphone of a prior art in FIG. 5 attach the same reference numerals and symbols as that in FIG. 5. Since the structure of the microphone capsule 20 of this embodiment is the same as that in FIG. 5, the description about the microphone capsule 20 win be omitted so that the structure of the capsule support 10A will be mainly described.

The capsule support 10A illustrated in FIG. 1 includes a cylindrical chassis 11 supported on the top end of a supporting pipe P formed in a goose-neck shape. The chassis 11 is formed with metal such as brass or aluminum. The capacitor microphone of the invention includes a pin type microphone which is put on clothes during it is used.

A printed circuit board 120 is housed in the chassis 11. A step 111 for receiving the circumference of a printed circuit board 120 and an internal screw 112 for screwing with an external screw of a fixing ring 150 are formed in the chassis 11 so that the fixing ring 150 is screwed into the chassis 11 to fix the printed circuit board 120.

As shown in FIG. 4*a*, a gate electrode pattern 122 connecting to a gate terminal of an impedance converter 13 through a through hole 121 is formed on the front surface (relating to the microphone capsule 20) of the printed circuit board 120 such that as shown in FIGS. 1 and 4*c*, the impedance converter 13 (FET in this embodiment) is mounted on the back surface (relating to the microphone capsule 20) of the printed circuit board 120.

A contacting terminal 140 which contacts to a contact pin 23 of the microphone capsule 20 is placed on the front surface of the printed circuit board 120 in the state that the contacting terminal 140 holds a block 180. As shown in FIG.

3, the contacting terminal 140 includes a bottom plate 141, a side plate 142 and a contacting piece 143. The side plate 142 extends at a substantially right angle toward the microphone capsule 20 from one end of the bottom plate 141 and the contacting piece 143 obliquely extends in the upper direction at a designated angle from the top end of the side plate 142. The whole of the contacting terminal 143 is formed in a substantial U-shape and is formed with a plate spring.

The bottom plate 141 is a contact member placed on the gate electrode pattern 122 of the printed circuit board 120 and it is preferable that the back side of the bottom plate 141 has contacting protrusions 141*a* contacting to the electrode pattern 122 with each of the contacting portions between the protrusions 141*a* and the pattern 122 formed in a spot or in a line. The shape of each of the contacting protrusions 141*a* can be optionally selected from a triangle, a semi-circle boss, a rib or the like.

The block 180 is formed with silicon synthetic resin or the like which has a moderate elasticity. It is preferable that a shape of the block 180 is a cylinder which has the substantially same height as that of the side plate 142 from the viewpoint that the block is held in the contacting terminal 140. The block 180 undertakes roles in retaining the original form of the contacting terminal 140 and in positioning the terminal 140 on the gate electrode pattern 122 in cooperation with a cap member 160 which will be described hereinafter.

The electric insulating cap member 160 is used to position the contacting terminal 140 as well as the block 180 on the gate electrode pattern 122. The cap member 160 includes an opening 161 and a substantially umbrella shaped skirt 162, the opening 161 fitting the block 180 with the cap member protruding the contacting piece 143 of the contacting terminal 140 in the upper direction, the skirt 162 disposed between the block 180 and the circumference of the printer circuit board 120.

The cap member 160 can be formed with either hard or soft resin, however, it is preferable that the cap member 160 is formed with natural or synthetic rubber in order to increase the air proof grade of the rear air chamber and to make the air volume of the chamber as small as possible and constant.

When the microphone capsule 20 is turned in order to remove the capsule from the capsule support 10A, it is preferable that anti-rotating means for preventing the contacting terminal 140 from rotating or twisting is formed in the opening 161 of the cap member 160. Therefore, in this example, a latching groove 161*a* is formed and the contacting piece 143 is latched with the groove 161*a* when the piece 143 is pressed by the contact pin 23.

The outer circumference of the fixing ring 150 as well as a fixing ring 15 of the prior art has an external screw 151 screwed with the internal screw 112 formed on the chassis 11 and screwed with an internal screw 241 of the microphone capsule 20. The inner surface of the fixing ring 150 has a step 152 for pressing the skirt 162 of the cap member 160 to the printed circuit board 120. The element attached with reference numeral 153 is a hooked hole for rotating the fixing ring 150 with the hooked hole hooked with a tool (not shown).

The fixing ring 150 is fastened to press the skirt 162 of the cap member 160 to the printed circuit board 120 and the circumference of the board 120 is fixed between the lower surface of the ring 150 and step 111 of the chassis 11. It is preferable that a ring shaped rubber packing 190 is placed between the skirt 162 of the cap member 160 and the board 120 to further increase the air proof grade of the rear air chamber.

The chassis 21 of the microphone capsule 20 and the chassis 11 of the capsule support 10A are electrically connected through the fixing ring 150. Since, as shown in FIGS. 4*a* and 4*c*, a ground pattern 123 which is connected to a ground terminal (the source or the drain terminal) except for the gate terminal of the impedance converter 13 is formed on the both sides of the circumference of the printed circuit board 120 so that the chassis 21, 11 are securely connected to the ground of the printed circuit board 120.

The upper surface of the ground pattern 123 of the printed circuit board 120 can be electrically conducted to the lower surface of the ground pattern 123 through a through hole 124. An electric cable 17 extracted through a supporting pipe 17 can be soldered and fixed to a given pattern on the lower surface of the printed circuit board 120 as well as in the prior art.

What is claimed is:

1. A capacitor microphone including a microphone capsule and a capsule support connected to each other through screw latching means, a vibrating plate and a fixed electrode disposed in the microphone capsule with the vibrating plate and the fixed electrode facing to each other, a contact pin extracted from the fixed electrode toward the capsule support, the capsule support including a printed circuit board and a contacting terminal, the printed circuit board having an impedance converter, the contacting terminal electrically contacting to a given terminal of the impedance converter, the contacting terminal formed with a plate spring elastically contacting to the contact pin, the microphone capsule and the capsule support connecting to each other through the screw latching means whereby the microphone capsule and the capsule support electrically contacting to each other, the capacitor microphone comprising:

the printed circuit board mounting the impedance converter on the back surface relating to the microphone capsule of the circuit board;

an electrode pattern electrically connecting to the given terminal of the impedance converter through predetermined conducting means, the electrode pattern formed on the front surface relating to the microphone capsule of the printed circuit board;

the contacting terminal including:

a bottom plate contacting to the electrode pattern;

a side plate extending at a substantially right angle toward the microphone capsule from one end of the bottom plate;

a contacting piece obliquely extending in the upper direction at a designated angle from the top end of the side plate;

wherein the contacting terminal is formed in a substantial U-shape with the bottom and the side plates, and the contacting piece;

an electric insulating block disposed on the bottom plate in the contacting terminal;

an electric insulating cap member having an opening and disposed between the electric insulating block and the circumference of the printed circuit board, the electric insulating block fitted in the opening with the contacting piece protruding in the upper direction; and a fixing ring mounted in a chassis of the capsule support while pressing the circumference of the cap member to the printed circuit board.

2. A capacitor microphone according to claim 1, wherein the contacting terminal further includes one or more contacting protrusions formed on the back side of the bottom plate.

3. A capacitor microphone according to claim 2, wherein the electric insulating cap member is formed with a rubber elastic body.

4. A capacitor microphone according to claim 2, wherein the capacitor microphone further comprises a ring shaped rubber packing disposed between the electric insulating cap member and the printed circuit board.

5. A capacitor microphone according to claim 2, wherein the opening of the electric insulating cap member has anti-rotating means for the contacting terminal.

6. A capacitor microphone according to claim 2, wherein a ground pattern is formed on the circumference of the printed circuit board, the ground pattern contacting to the chassis of the capsule support and the fixing ring, the both chassis of the microphone capsule and the capsule support securely connected to the ground of the printed circuit board with the microphone capsule and the capsule support electrically connected to each other.

7. A capacitor microphone according to claim 1, wherein the electric insulating cap member is formed with a rubber elastic body.

8. A capacitor microphone according to claim 7, wherein the capacitor microphone further comprises a ring shaped rubber packing disposed between the electric insulating cap member and the printed circuit board.

9. A capacitor microphone according to claim 7, wherein the opening of the electric insulating cap member has anti-rotating means for the contacting terminal.

10. A capacitor microphone according to claim 7, wherein a ground pattern is formed on the circumference of the printed circuit board, the ground pattern contacting to the chassis of the capsule support and the fixing ring, the both chassis of the microphone capsule and the capsule support securely connected to the ground of the printed circuit board with the microphone capsule and the capsule support electrically connected to each other.

11. A capacitor microphone according to claim 1, wherein the capacitor microphone further comprises a ring shaped rubber packing disposed between the electric insulating cap member and the printed circuit board.

12. A capacitor microphone according to claim 11, wherein the opening of the electric insulating cap member has anti-rotating means for the contacting terminal.

13. A capacitor microphone according to claim 11, wherein a ground pattern is formed on the circumference of the printed circuit board, the ground pattern contacting to the chassis of the capsule support and the fixing ring, the both chassis of the microphone capsule and the capsule support securely connected to the ground of the printed circuit board with the microphone capsule and the capsule support electrically connected to each other.

14. A capacitor microphone according to claim 1, wherein the opening of the electric insulating cap member has anti-rotating means for the contacting terminal.

15. A capacitor microphone according to claim 14, wherein a ground pattern is formed on the circumference of the printed circuit board, the ground pattern contacting to the chassis of the capsule support and the fixing ring, the both chassis of the microphone capsule and the capsule support securely connected to the ground of the printed circuit board with the microphone capsule and the capsule support electrically connected to each other.

16. A capacitor microphone according to claim 1, wherein a ground pattern is formed on the circumference of the printed circuit board, the ground pattern contacting to the chassis of the capsule support and the fixing ring, the both chassis of the microphone capsule and the capsule support securely connected to the ground of the printed circuit board with the microphone capsule and the capsule support electrically connected to each other.

* * * * *